United States Patent [19]

Ritschel et al.

[11] Patent Number: 4,724,124

[45] Date of Patent: Feb. 9, 1988

[54] USE OF ALKENYLSUCCINIC ACID HALF-AMIDES AS ANTI-CORROSION AGENTS

[75] Inventors: Werner Ritschel, Hofheim; Horst Lorke, Liederbach, both of Fed. Rep. of Germany

[73] Assignee: Hoechst Aktiengesellschaft, Frankfurt am Main, Fed. Rep. of Germany

[21] Appl. No.: 913,128

[22] Filed: Sep. 26, 1986

[30] Foreign Application Priority Data

Sep. 27, 1985 [DE] Fed. Rep. of Germany ..... 3534439

[51] Int. Cl.[4] ..... C23F 11/04

[52] U.S. Cl. ..... 422/16; 422/13; 422/7; 252/49.3; 252/392

[58] Field of Search ..... 422/13, 16, 7; 252/49.3, 392

[56] References Cited

U.S. PATENT DOCUMENTS 3,269,946 8/1966 Wiese ..... 252/51.5 A
3,324,033 6/1967 Knapp ..... 252/51.5 A
4,289,636 9/1981 Davis et al. ..... 252/49.3
4,379,063 4/1983 Williams ..... 252/49.3 X
4,609,531 9/1986 Ritschel et al. ..... 422/13

FOREIGN PATENT DOCUMENTS 3300874 7/1984 Fed. Rep. of Germany ..... 252/49.3
1532836 11/1978 United Kingdom ..... 252/49.3

*Primary Examiner*—Matthew A. Thexton

[57] ABSTRACT

The use, as anti-corrosion agents, of alkenylsuccinic acid half-amides of the formulae

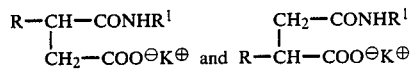

in which R denotes $C_6$–$C_{18}$-alkenyl, $R^1$ denotes $C_{12}$–$C_{18}$-alkyl and K denotes a proton, an alkali metal ion or an ammonium ion of the formula $NHR^2R^3R^4$, and $R^2$, $R^3$ and $R^4$ are identical or different and denote hydrogen, $C_1$–$C_{12}$-alkyl, 2-hydroxyethyl or 2-hydroxypropyl.

4 Claims, No Drawings

USE OF ALKENYLSUCCINIC ACID HALF-AMIDES AS ANTI-CORROSION AGENTS

The use of salts of alkenylsuccinic acid half-amides of the formulae

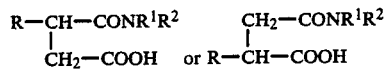

in which R denotes $C_6$–$C_{18}$-alkenyl and $R^1$ and $R^2$ denote hydrogen or $C_1$–$C_{10}$-alkyl as anti-corrosion agents in aqueous systems is already known (German Pat. Nos. 3,300,874, 3,319,183 and 3,341,013). Although these compounds display a very good anti-corrosion action in aqueous metal working fluids free from mineral oil, they are frequently unsuitable for use in formulations containing mineral oils, since these compounds are not soluble, or are not sufficiently soluble, in mineral oil. This results in a separation of the mineral oil emulsions into an aqueous phase and an oil-containing phase, and the use value of these compounds is therefore greatly restricted.

It has now been found that these disadvantages of the known alkenylsuccinic acid half-amides can be avoided if the amide group is substituted by a $C_{12}$–$C_{18}$-alkyl radical. The invention relates to the use, as anti-corrosion agents, of alkenylsuccinic acid half-amides of the formulae

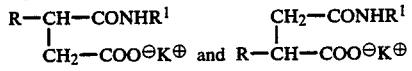

in which R denotes $C_6$–$C_{18}$-alkenyl, preferably $C_9$–$C_{12}$-alkenyl, $R^1$ denotes $C_{12}$–$C_{18}$-alkyl, preferably $C_{12}$–$C_{14}$-alkyl, and K denotes a proton, an alkali metal ion or an ammonium ion of the formula $NHR^2R^3R^4$ and $R^2$, $R^3$ and $R^4$ are identical or different and denote hydrogen, $C_1$–$C_{12}$-alkyl, 2-hydroxyethyl or 2-hydroxypropyl.

The preparation of the alkenylsuccinic acid half-amides is carried out in a known manner by heating an alkenylsuccinic anhydride with an amine of the formula $NH_2R^1$ in an approximately equimolar ratio for approx. 2 hours at 70° to 90° C. The compounds obtained thereby can be employed without further treatment, i.e. in the form of the free acid, as anti-corrosion agents in metal working fluids. It is preferable, however, to use these alkenylsuccinic acid half-amides in the form of their alkali metal or alkanolamine salts. These salts can be prepared in a simple manner by neutralizing the alkenylsuccinic acid half-amides, for example by neutralization with sodium hydroxide solution, monoethanolamine, diethanolamine or triethanolamine.

The alkenylsuccinic acid half-amides described above can be employed with particular advantage as anti-corrosion agents in aqueous cooling lubricants and cooling lubricants containing mineral oil, in particular drilling, cutting and rolling fluids. These cooling lubricants are prepared by stirring the reaction products into the required amount of water or mineral oil. The concentration used in the drilling, cutting and rolling fluids is generally about 0.1 to 10% by weight, preferably 2 to 5% by weight. If necessary, it is also possible to add further active compounds which are known for this end use.

Depending on the amount of mineral oil, the alkenylsuccinic acid half-amides described produce clear or milky, emulsion-like fluids which retain their good properties in use over a fairly long period of time, since no creaming or phase separation takes place even after several days.

The following examples illustrate the invention; the subsequent tables 1 to 3 show the excellent properties of the products compared with the comparison substances A and B.

EXAMPLE 1

N-coconut-alkyltripropenylsuccinic acid half-amide 197 g (1 mol) of coconut oil amine are placed in a reaction flask and 224 g (1 mol) of tripropenylsuccinic anhydride are added dropwise, with stirring. In the course of this the temperature rises rapidly. The internal temperature is kept between 70° and 90° C. by cooling with a water-bath. When the dropwise addition is complete, the mixture is stirred for a further 90 minutes at 80° C. and is then allowed to cool to room temperature. Approx. 420 g of a viscous liquid having an acid number of approx. 130 (theory: 133.3) are obtained.

EXAMPLE 2

N-dodecyltetrapropenylsuccinic acid half-amide 266 g (1 mol) of tetrapropenylsuccinic anhydride are added dropwise to 185 g (1 mol) of dodecylamine, and the procedure of Example 1 is followed. Approx. 450 g of a viscous liquid having an acid number of approx. 125 (theory: 124.4) are obtained.

EXAMPLE 3

N-(dodecyl/tetradecyl)-tripropenylsuccinic acid half-amide 196 g of a mixture of dodecylamine and tetradecylamine (molar ratio 75:25) are initially taken at room temperature, 224 g (1 mol) of tripropenylsuccinic anhydride are added dropwise, with stirring, and the further procedure is as in Example 1. Approx. 420 g of a viscous liquid having an acid number of approx. 130 (theory: 133.6) are obtained.

COMPARISON SUBSTANCE A

N-butyltripropenylsuccinic acid half-amide 72 g (1 mol) of n-butylamine are initially taken and 224 g (1 mol) of tripropenylsuccinic anhydride are added dropwise at such a rate that the internal temperature does not exceed 80° C. When the dropwise addition is complete, the mixture is stirred for a further 30 minutes at 80° C. and is then allowed to cool. Approx. 295 g of a viscous liquid having an acid number of approx. 190 (theory: 189.5) are obtained.

COMPARISON SUBSTANCE B

N,N-dioctyltripropenylsuccinic acid half-amide 250 g (1 mol) of dioctylamine are initially taken at room temperature. 224 g (1 mol) of tripropenylsuccinic anhydride are added dropwise, with stirring, in the course of which the temperature rises to 80° C. When the dropwise addition is complete, the mixture is stirred for a further 2½ hours at 80° C. and is then allowed to cool. Approx. 470 g of a viscous liquid having an acid number of approx. 120 (theory: 118) are obtained.

TABLE 1

| Formulation/example | | 1 | 2 | 3 | A | B |
|---|---|---|---|---|---|---|
| Product according to example | | 44.1 g | 45.6 g | 43.0 g | 25.4 g | 57.2 g |
| Triethanolamine | | 40.9 g | 39.4 g | 42.0 g | 59.6 g | 37.8 g |
| Distilled water | | 15.0 g | 15.0 g | 15.0 g | 15.0 g | 15.0 g |
| Appearance at 20° C. | | clear, liquid | clear, liquid | cloudy | clear, liquid | cloudy, separates |
| SOLUBILITY IN $H_2O$ | | | | | | |
| 3% strength in distilled $H_2O$ | | | | | | |
| — immediately | | clear | clear | clear | transparent | transparent |
| — after 24 hours | | unchanged | unchanged | unchanged | cloudy | cloudy |
| pH value | | 9.3 | 9.3 | 9.2 | 9.4 | 9.5 |
| 1% strength in distilled $H_2O$ | | | | | | |
| CORROSION RESISTANCE | | | | | | |
| Herbert Test DIN 51360/1 | 0.5% | trace of rust | considerable rust | considerable rust | considerable rust | considerable rust |
| | 1.0% | no rust | trace of rust | trace of rust | rust | considerable rust |
| | 2.0% | no rust | no rust | no rust | no rust | no rust |
| Filter paper test DIN 51,360/2 | 1.0% | rust | rust | rust | considerable rust | considerable rust |
| | 2.0% | no rust | trace of rust | trace of rust | rust | rust |
| | 2.5% | no rust | trace of rust | no rust | no rust | no rust |

TABLE 2

| Formulation/example | | 1 | 2 | 3 | A | B |
|---|---|---|---|---|---|---|
| Product according to example | | 80 g | 80 g | 80 g | 66 g | 81 g |
| Triethanolamine | | 5 g | 5 g | 5 g | 15 g | 4 g |
| Sodium hydroxide solution, 40% strength | | 15 g | 15 g | 15 g | 19 g | 15 g |
| Appearance at 20° C. | | clear, liquid | clear, liquid | clear, liquid | milky, cloudy | clear, liquid |
| Solubility, 3% strength in distilled $H_2O$ | | | | | | |
| immediately | | clear | clear | clear | transparent | cloudy |
| after 24 hours | | unchanged | cloudy | cloudy | cloudy | cloudy |
| pH value | | 9.3 | 9.2 | 9.1 | 9.2 | 9.1 |
| 1% strength in distilled $H_2O$ | | | | | | |
| Corrosion resistance | | | | | | |
| Herbert Test DIN 51360/1 | 0.5% | rust | rust | rust | considerable rust | considerable rust |
| | 1.0% | no rust | trace of rust | trace of rust | rust | considerable rust |
| Filter paper test DIN 51360/2 | 1.0% | rust | rust | rust | rust | considerable rust |
| | 2.0% | no rust | no rust | no rust | trace of rust | considerable rust |
| | 2.5% | no rust | no rust | no rust | no rust | rust |

TABLE 3

| Formulation/example | | 1 | 2 | 3 | A | B |
|---|---|---|---|---|---|---|
| Product according to example | | 80 g | 85 g | 80 g | 66 g | 81 g |
| Triethanolamine | | 5 g | 5 g | 5 g | 15 g | 4 g |
| Sodium hydroxide solution, 40% strength | | 15 g | 10 g | 15 g | 19 g | 15 g |
| FORMULATION: | | | | | | |
| Na triethanolamine salt from example | | 24.0 g | 24.0 g | 24.0 g | 24.0 g | 24.0 g |
| Nonylphenol + 6 mol of ethylene oxide | | 6.8 g | 6.8 g | 6.8 g | 6.8 g | 6.8 g |
| Distilled water | | 3.0 g | 3.0 g | 3.0 g | 3.0 g | 3.0 g |
| Mineral oil | | 66.2 g | 66.2 g | 66.2 g | 66.2 g | 66.2 g |
| Appearance at 20° C. | | clear, liquid | clear, liquid | clear, liquid | milky, cloudy | clear, liquid |
| SOLUBILITY in distilled $H_2O$ | | | | | | |
| immediately | | milky | milky | milky | coarse milky | milky |
| after 24 hours | | unchanged | cream | cream | separated | cream |
| pH value | | 9.0 | 9.0 | 9.0 | 9.1 | 9.0 |
| 1% strength in distilled $H_2O$ | | | | | | |
| CORROSION RESISTANCE | | | | | | |
| Herbert Test | 1.0% | rust | considerable rust | rust | | considerable rust |
| | 2.0% | rust | rust | rust | | considerable |

TABLE 3-continued

| Formulation/example | | 1 | 2 | 3 | A | B |
|---|---|---|---|---|---|---|
| | | | | | | rust |
| | 3.0% | no rust | trace of rust | no rust | | considerable rust |
| Filter paper test | 3.0% | considerable rust | considerable rust | considerable rust | | considerable rust |
| | 5.0% | no rust | trace of rust | trace of rust | | considerable rust |

We claim:

1. A method for inhibiting corrosion of metals in contact with a cooling lubricant comprising the step of adding to said lubricant an effective amount of alkenylsuccinic acid of the formulae

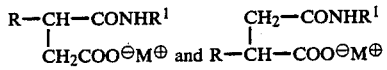

in which R denotes $C_6$–$C_{18}$ alkenyl, $R^1$ denotes $C_{12}$–$C_{18}$ alkyl, and M denotes a proton, an alkali metal ion or an ammonium ion of the formula $NHR^2R^3R^4$, and $R^2$, $R^3$ and $R^4$ are identical or different and denote hydrogen, $C_1$–$C_{12}$-alkyl, 2-hydroxyethyl or 2-hydroxypropyl.

2. A method according to claim 1, wherein R denotes $C_9$–$C_{12}$-alkenyl.

3. A method according to claim 1 wherein $R^1$ denotes $C_{12}$–$C_{14}$-alkyl.

4. A method according to claim 1, wherein $R^2$ denotes $C_{12}$–$C_{14}$ alkyl.

* * * * *